US006955142B2

(12) United States Patent
Patel et al.

(10) Patent No.: US 6,955,142 B2
(45) Date of Patent: Oct. 18, 2005

(54) PISTON AND CYLINDER OIL SQUIRTER RAIL AND SYSTEM

(75) Inventors: Dipak R. Patel, Grand Blanc, MI (US); John D. Douro, Ortonville, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/786,841

(22) Filed: Feb. 25, 2004

(65) Prior Publication Data

US 2005/0183677 A1 Aug. 25, 2005

(51) Int. Cl.[7] ..... F01P 1/04
(52) U.S. Cl. ..... 123/41.35; 123/196 S
(58) Field of Search ..... 123/41.35, 196 S

(56) References Cited

U.S. PATENT DOCUMENTS 1,612,372 A * 12/1926 Gussman ..... 123/41.35
2,788,773 A * 4/1957 Meurer ..... 123/41.35
4,508,065 A 4/1985 Suchdev ..... 123/41.35
4,667,630 A * 5/1987 Sasaki ..... 123/41.35

FOREIGN PATENT DOCUMENTS

JP 06264742 A * 9/1994 ..... F01P 3/08

* cited by examiner

*Primary Examiner*—Noah P. Kamen
(74) *Attorney, Agent, or Firm*—Christopher DeVries

(57) ABSTRACT

The present invention provides an oil squirter system for lubricating and cooling engine pistons and cylinders during various engine operating conditions. The oil squirter system includes a generally tubular oil supply manifold having an inlet connected to a pressurized engine oil source and at least one outlet connected to at least one oil supply rail. The oil supply rail includes a longitudinal manifold tube with integral oil squirter nozzles and attachment brackets. An oil flow control valve placed before the oil supply manifold controls oil flow to the oil rails and nozzles. The oil flow control valve responds to engine requirements and performance objectives to maintain adequate oil flow through the oil squirter system to the pistons and cylinders bores as needed to maintain optimal engine operation, preferably during startup and at higher engine speed operation.

8 Claims, 4 Drawing Sheets

PISTON AND CYLINDER OIL SQUIRTER RAIL AND SYSTEM

TECHNICAL FIELD

This invention relates to internal combustion engines, and more particularly, to oil squirters for piston cooling and cylinder bore lubrication.

BACKGROUND OF THE INVENTION

Oil squirters have been used in engines to cool pistons and lubricate cylinder bore walls. Some large diesel engines have provided piston cooling through a crankcase mounted oil manifold connected with separate piston cooling tubes that direct cooling oil into a piston cooling cavity.

In smaller automotive engines, individual nozzles connected to a cylinder block oil gallery have been proposed for piston cooling and cylinder lubrication. Individual nozzles must be individually installed in an engine. Sometimes, the installer may need to bend the nozzles for proper alignment. When installed, the nozzles receive oil from an engine oil source and direct oil to associated reciprocating pistons or cylinders.

Improved squirter system concepts are desired to reduce costs and assembly time while maintaining the advantages of an individual oil squirter system.

SUMMARY OF THE INVENTION

The present invention provides one or more oil squirter rails for cooling engine pistons and lubricating cylinder bores during various engine operating conditions. The rails are integrated assemblies, each including a longitudinal tube with a plurality of longitudinally spaced lateral nozzles configured so that, when the rails are installed, the nozzles are positioned to direct oil into the cylinders and/or the pistons in the cylinders. An oil flow control valve may be included that responds to engine conditions or may be controlled to meet engine requirements and performance objectives by selectively providing piston or cylinder oil delivery as needed to maintain optimal engine operation, for example during startup and high speed engine operation.

Oil squirter rails may be used in various automotive engine types including inline and multi-bank engine blocks. In an exemplary embodiment, a V-type engine includes two cylinder banks, each with multiple cylinders carrying reciprocable pistons. Positioned below the cylinders is a crankcase enclosing a crankshaft and closed by an oil pan having an oil sump.

Two oil squirter rails, one for each cylinder bank, are mounted in the engine crankcase with their nozzles aimed to direct oil into the cylinders and/or against the pistons of separate cylinders. An oil supply manifold in the oil pan directs oil to connecting passages in the pan to which the oil squirter rails are connected. An oil flow control valve at the inlet of the oil supply manifold controls oil flow to the oil rails and nozzles.

The nozzles are selected for specific engine applications so that they provide adequate lubrication under all engine operating conditions. In addition, each nozzle is prealigned on the squirter rail before installation, so that when the oil squirter rail is fastened to the engine, each nozzle will be properly aligned to spray oil on an associated piston and/or cylinder bore wall.

Attachment brackets fixed to the rails are used to fasten the oil squirter rails within the engine crankcase. Various alternative modes of attachment may be utilized. For example, the attachments may connect with bearing cap studs used for windage tray attachment, they may be retained by bearing cap side bolts extending through the crankcase into the bearing caps, or they may be trapped between opposed surfaces of crankcase webs and associated main bearing caps of the engine.

An exemplary embodiment of a mechanical flow control valve comprises a spring biased ball valve. When the oil pressure is low, as at engine idle or low speed driving, the valve spring closes the valve to cut off oil flow to the oil squirter rail. At higher engine speeds, increased oil pressure opens the ball valve to deliver full oil flow to the squirter nozzles for cooling the pistons.

An alternative embodiment of flow control is an electrically-controlled solenoid valve actuated by an electronic engine power control module. The control may be programmed to shut off squirter oil flow at idle and low engine speeds and to open to full flow at higher engine speeds for piston cooling. If desired, the pressure control module may also open the solenoid valve to activate the oil squirters during engine startup to provide early lubrication to the cylinders for quieting piston motion.

These and other features and advantages of the invention will be more fully understood from the following description of certain specific embodiments of the invention taken together with the accompanying drawings.

DESCRIPTION OF THE PREFERRED EMBODIMENT

Figure 1:
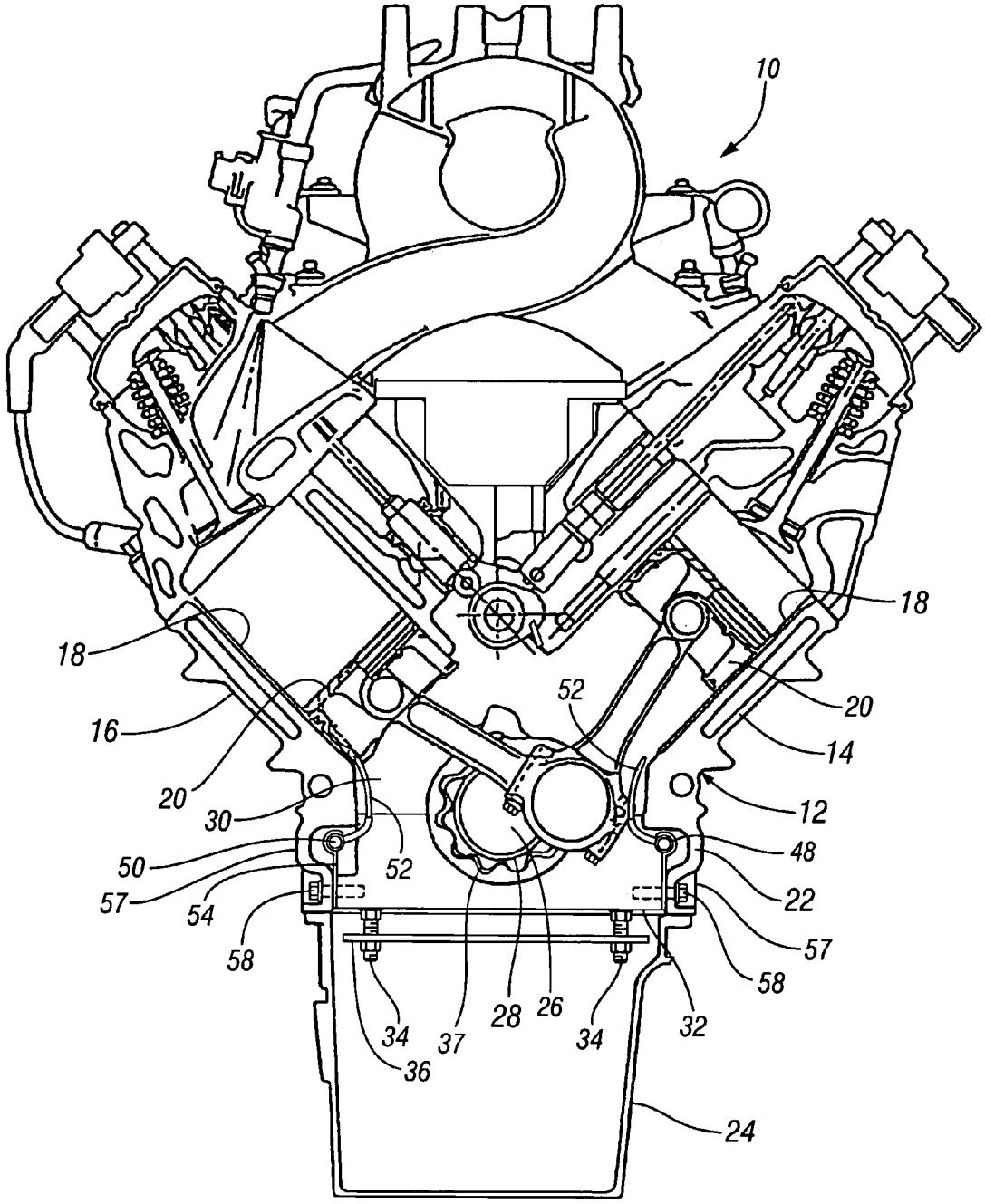
FIG. 1 is a cross-sectional view of a V-type internal combustion engine having a piston and cylinder oil squirter system with squirter rails in accordance with the invention.

Referring first to FIG. 1 of the drawings in detail, numeral 10 generally indicates a V-type automotive internal combustion engine including a cylinder block 12 with a pair of angled cylinder banks 14, 16, each having a plurality of aligned cylinders 18, each carrying a reciprocable piston 20. A crankcase 22 closed by an oil pan 24 is positioned below the cylinders 18.

The crankcase 22 carries a rotatable crankshaft 26 within aligned main bearings 28. The main bearings 28 are supported by webs 30 of the crankcase 22 and main bearing caps 32 secured to the webs by studs 34 extending from the webs 30 through the caps 32. A windage 36 tray is attached to the studs 34 below the main bearing caps 32.

The oil pan 30 forms an oil sump for the engine 10. An engine oil pump 37 draws oil from the sump and directs pressurized oil to a main oil feed 38 (FIG. 2) which supplies engine oil passages with oil for cooling and lubrication of the engine 10.

Figure 2:
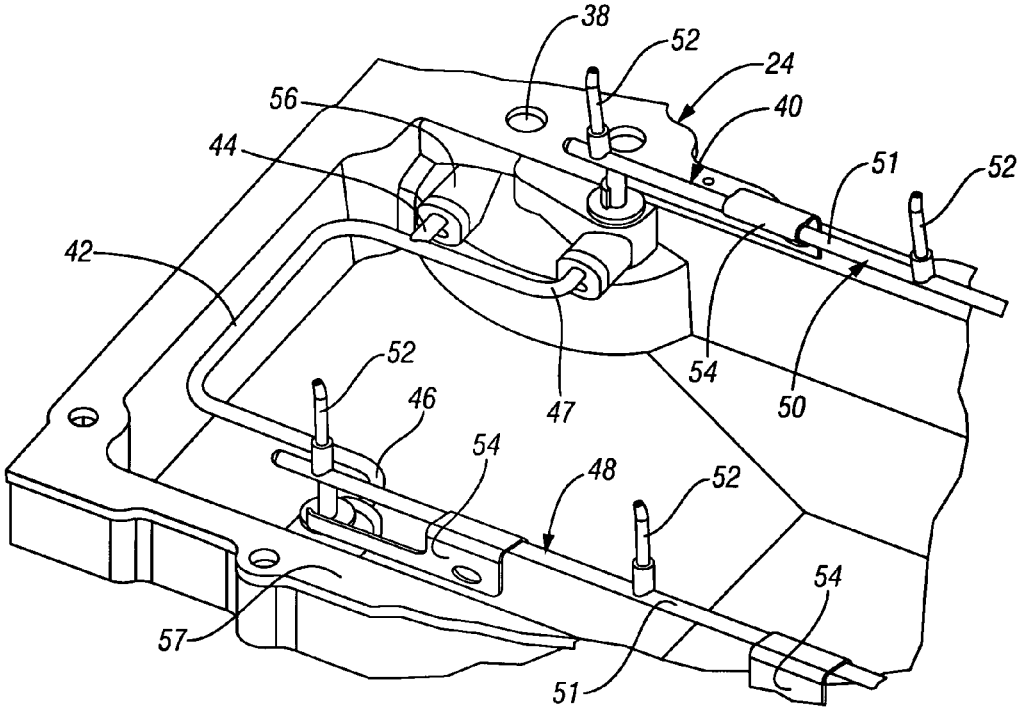
FIG. 2 is a pictorial view of an oil squirter system similar to that of FIG. 1, but including an oil pan mounting an oil supply manifold and control valve with connections to dual oil squirter rails carried in the engine block, not shown.
Figure 3:
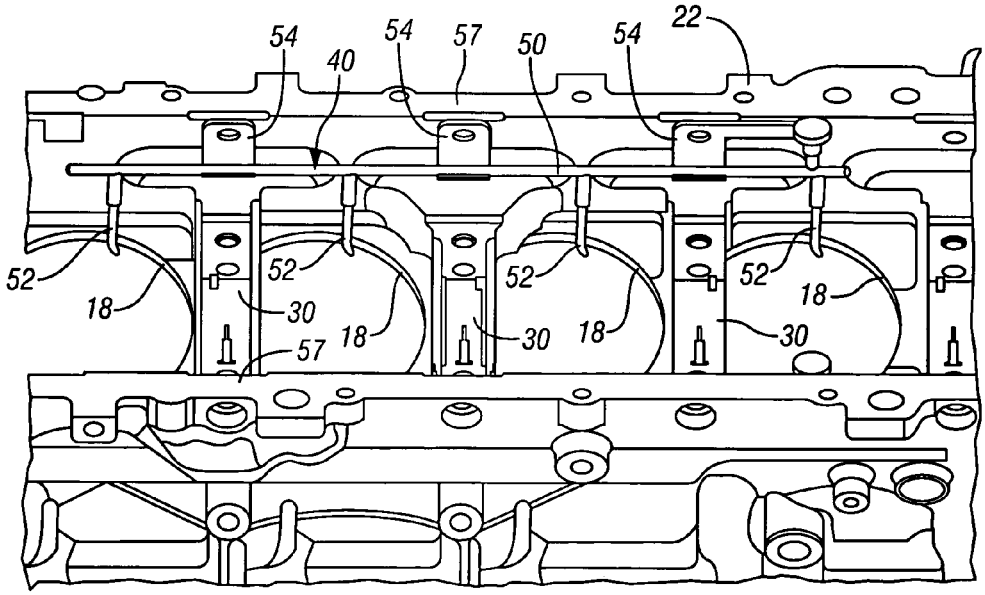
FIG. 3 is a pictorial view showing a squirter rail with attachment brackets mounted between crankcase side walls and bearing caps, not shown, similar to the engine of FIG. 1.

Referring to FIGS. 1–3, the engine 10 is provided with a piston and cylinder bore oil squirter system 40 formed according to the invention. System 40 includes a generally tubular oil supply manifold 42 mounted in the oil pan 24. Manifold 42 includes an inlet 44 connected to the main oil feed 38 and outlets 46, 47 connected through the oil pan with a pair of oil squirter rails 48, 50. The oil squirter rails 48, 50 each include a longitudinal manifold tube 51 with integral oil squirter nozzles 52 and attachment brackets 54. An oil flow control valve 56, located in the oil pan 24 at the inlet 44 of the oil supply manifold 42, controls oil flow through the oil squirter system 40.

The above-described system having two oil supply rails 48, 50 is intended for a V-type engine. However, the oil supply system 40 may be modified to be useable with inline and other engine arrangements.

The nozzles 52 are selected for a specific engine applications so that they provide adequate lubrication under all operating conditions. In addition, each nozzle 52 is pre-aligned on the oil supply rails 48, 50 so that when the oil squirter system 40 is fastened to the engine 10, each nozzle sprays oil on an associated piston 20 and cylinder 18 as shown in FIG. 1.

Figure 4:
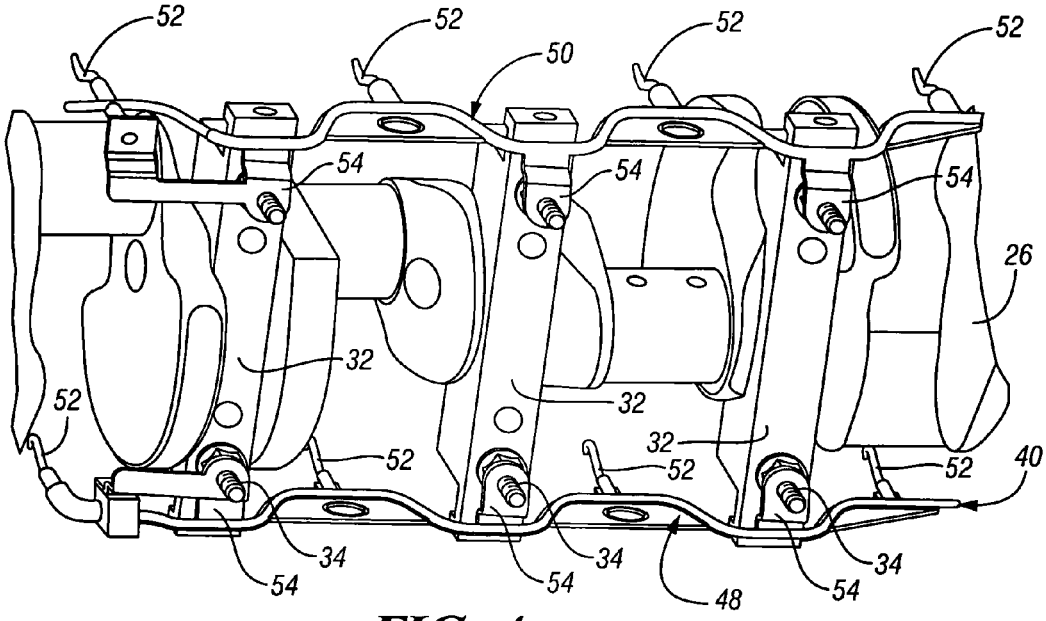
FIG. 4 is a pictorial view showing alternative squirter rail brackets attached to bearing cap studs of an engine.
Figure 5:
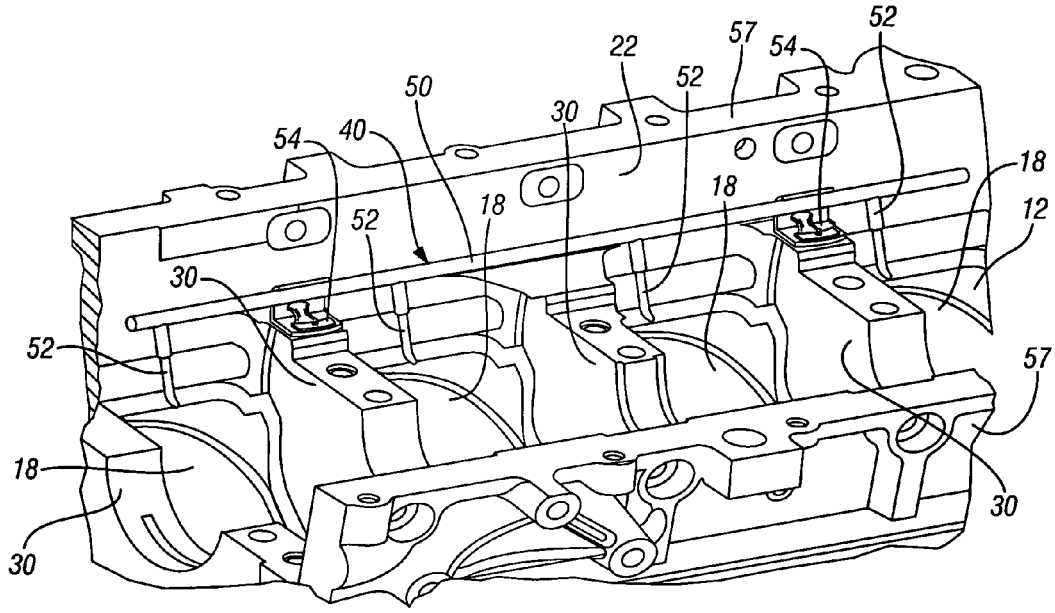
FIG. 5 is a pictorial view showing a squirter rail with attachment brackets located to be trapped above bearing caps of an engine.

The attachment brackets 54 may be used to fasten the oil squirter rails 48, 50 to various components within the crankcase 22 of the engine 10. Depending upon the application and engine design, the attachments 54 may be adapted to be retained between the crankcase walls 57 and the bearing caps 32 by bearing cap side bolts 58 extending through the crankcase walls 57 into the main bearing caps 32 as shown in FIGS. 1 and 3. Alternatively, the attachments 54 may be secured to the bearing cap studs 34 between the bearing caps 32 and the windage tray 36, as shown in FIG. 4. In another embodiment, the attachment brackets 54 may be trapped between the bearing caps 32 and the crankcase webs 30 of the engine 10, as shown in FIG. 5.

Figure 6:
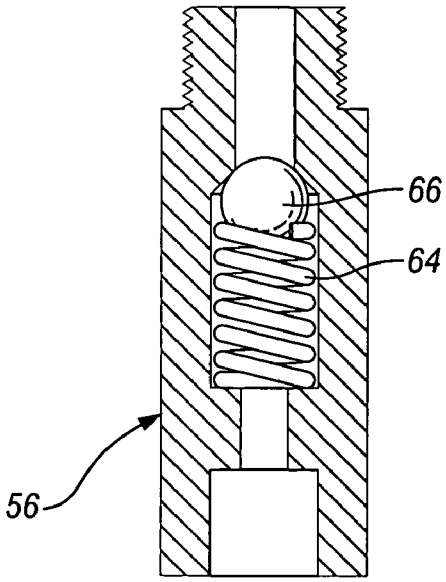
FIG. 6 is a cross-sectional view of a spring ball mechanical flow control valve.

In an exemplary embodiment of the oil squirter system 40, as shown in FIG. 6, the oil flow control valve 56 is a mechanical valve and includes a biasing spring 64 and ball 66, to block oil flow into the oil squirter rails until a prescribed oil pressure is reached.

During engine operation, oil is drawn from the sump of oil pan 24 by the oil pump and directed through an oil filter, not shown, into the main oil feed 38. A portion of the oil in the main oil feed 38 is directed through the oil flow control valve 56 into the inlet 44 of the supply manifold 42 of the oil squirter system 40.

At low engine rpm, oil pressure directed to the inlet 42 of the manifold 40 is not great enough to unseat the ball 66 against the force of the biasing spring 64 to open the flow control valve 56. As a result, the flow control valve 56 prevents oil flow into the inlet 44 of the oil supply manifold 42 to shut off the oil squirter system 40. As engine speed increases, additional oil pressure is generated until, at a preset pressure, the force of the oil pressure overcomes the biasing spring and unseats the ball 66. This opens the flow control valve 56 and directs oil through the oil squirter rails to the pistons 20 and cylinders 18.

As engine speed decreases, oil pressure to the inlet 44 of the oil supply manifold 42 decreases. This allows the biasing spring 64 seat the ball 66, closing the valve to cut off oil flow to the oil squirter system and avoiding unnecessary oil use by the oil squirter system 40.

Figure 7:
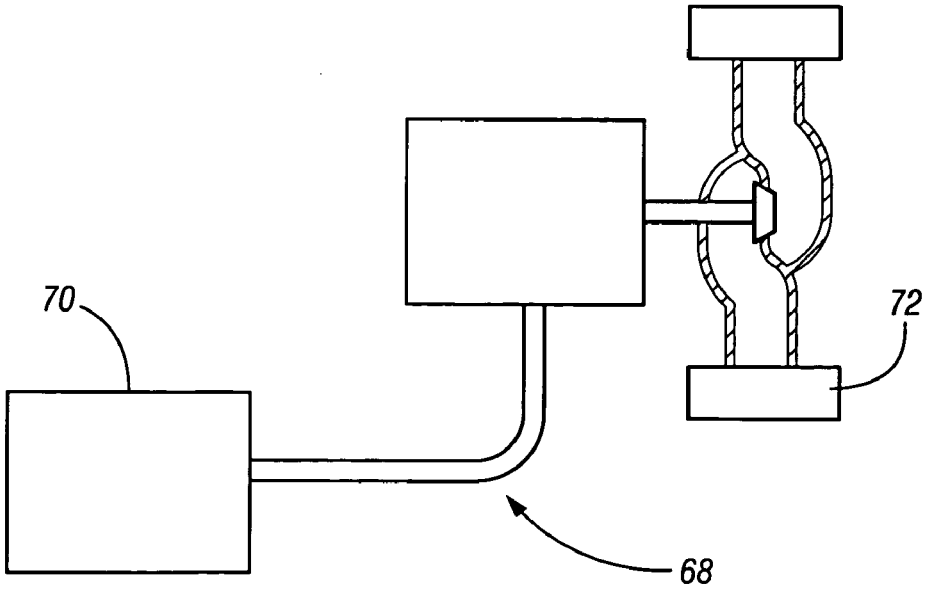
FIG. 7 is a diagrammatic view of a module-controlled solenoid flow control valve in accordance with the invention.

In a second embodiment, as shown in FIG. 7, the flow control valve 56 is replaced with an electronic flow control 68, which may be controlled by an engine power control module (PCM) 70 programmed to control an electric solenoid valve 72.

During engine operation, when the oil squirter system is equipped with the electronic flow control 68, the PCM 70 actuates the solenoid valve 72 within the oil supply manifold 42 to activate and deactivate the oil squirter system 40 as needed. During engine startup, the PCM 70 may open the solenoid valve 72 to allow oil flow into the inlet 44, thereby activating the oil squirter system 40 to provide the cylinders 18 and pistons 20 of the engine 10 with additional lubrication. At low engine rpm, the PCM 70 may close the solenoid valve 72 to restrict oil flow into the inlet 44 and deactivate the oil squirter system 40. As engine rpm increases, the PCM 70 actuates the solenoid valve to activate the oil squirter system 40 to spray oil on the pistons 20 and cylinders 18 for lubrication and cooling purposes.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An oil squirter rail for lubricating or cooling multiple cylinders or pistons of an internal combustion engine having a crankcase positioned below the cylinders, the pistons being reciprocable in the cylinders and the oil squirter rail comprising:

an assembly adapted to be mounted within the crankcase and including a longitudinal tube and a plurality of laterally extending longitudinally spaced nozzles permanently fixed to the tube and configured to direct oil from the tube against the cylinders or pistons when installed in an associated engine, the assembly including a plurality of attachments for securing the rail within an engine crankcase;

wherein the attachments are adapted to associate support of the oil squirter rail with bearing caps of the engine.

2. An oil squirter rail as in claim 1 wherein the attachments are adapted to connect the oil squirter rail to said bearing caps of the engine.

3. An oil squirter rail as in claim 1 wherein the attachments are adapted to connect the oil squirter rail to bearing cap studs of the engine.

4. An oil squirter system adapted for lubricating or cooling multiple cylinders or pistons of an internal combustion engine, the engine including a crankcase positioned below the cylinders and the pistons being reciprocable in the cylinders, the oil system comprising:

a first oil squirter rail mounted within the crankcase and including a longitudinal tube and a plurality of laterally extending longitudinally spaced nozzles permanently fixed to the tube and configured to deliver oil from the tube against the cylinders or pistons when installed in an associated engine; the rail including a plurality of attachments securing the rail within an engine crankcase;

wherein the attachments associate support of the oil squirter rail with bearing caps of the engine.

5. An oil squirter rail as in claim 4 wherein the attachments connect the oil squirter rail to bearing caps of the engine.

6. An oil squirter rail as in claim 4 wherein the attachments connect the oil squirter rail to bearing cap studs of the engine.

7. An oil squirter system adapted for lubricating or cooling multiple cylinders or pistons of an internal combustion engine, the engine including a crankcase positioned below the cylinders and the pistons being reciprocable in the cylinders, the oil system comprising:

a first oil squirter rail mounted within the crankcase and including a longitudinal tube and a plurality of laterally extending longitudinally spaced nozzles permanently fixed to the tube and configured to deliver oil from the tube against the cylinders or pistons when installed in an associated engine; and a flow control valve positioned to regulate oil flow through the system; wherein the flow control valve is a solenoid valve operable to selectively control oil flow through the system;

a control module actuates the solenoid valve to close or open the system to oil flow; and the control module actuates the solenoid valve to open system oil flow during engine startup for initially lubricating the cylinders.

8. An oil squirter system as in claim 7 wherein the control module actuates the solenoid valve to stop piston cooling oil flow at low engine speeds and open piston cooling oil flow at higher engine speeds.

* * * * *